US007208449B2

(12) United States Patent
Sano et al.

(10) Patent No.: US 7,208,449 B2
(45) Date of Patent: Apr. 24, 2007

(54) DECOLORABLE IMAGE FORMING MATERIAL

(75) Inventors: Kenji Sano, Tokyo (JP); Satoshi Takayama, Kawasaki (JP); Masanori Ogiue, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 71 days.

(21) Appl. No.: 11/036,994

(22) Filed: Jan. 19, 2005

(65) Prior Publication Data

US 2005/0159311 A1 Jul. 21, 2005

(30) Foreign Application Priority Data

Jan. 20, 2004 (JP) ..... 2004-012045

(51) Int. Cl.
*B41M 5/30* (2006.01)

(52) U.S. Cl. ..... 503/216; 106/31.17; 427/140; 430/108.1; 430/108.4; 503/209

(58) Field of Classification Search ..... 503/200–226
See application file for complete search history.

(56) References Cited

U.S. PATENT DOCUMENTS 4,028,118 A * 6/1977 Nakasuji et al. ..... 106/31.19
4,601,588 A * 7/1986 Takahara et al. ..... 374/106
5,922,115 A 7/1999 Sano et al.
6,017,386 A 1/2000 Sano et al.
6,203,603 B1 3/2001 Takayama et al.
6,248,692 B1 6/2001 Sano et al.
2005/0159311 A1 7/2005 Sano et al.

FOREIGN PATENT DOCUMENTS

EP 0 987 123 A2 3/2000
EP 1 041 447 A1 10/2000
EP 1 179 435 A1 2/2002
JP 2000-56497 2/2000

OTHER PUBLICATIONS

U.S. Appl. No. 11/266,326, filed Nov. 4, 2005, Takayama et al.

* cited by examiner

*Primary Examiner*—Bruce H. Hess
(74) *Attorney, Agent, or Firm*—Oblon, Spivak, McClelland, Maier & Neustadt, P.C.

(57) ABSTRACT

A decolorable image forming material contains a color former and a developer, that develop a colored state through interaction therebetween and can be decolored by heating or contact with a solvent, in which the developer contains two or more compounds whose deference in molecular weight is 15 or more.

14 Claims, 2 Drawing Sheets

DECOLORABLE IMAGE FORMING MATERIAL

CROSS-REFERENCE TO RELATED APPLICATIONS

This application is based upon and claims the benefit of priority from prior Japanese Patent Application No. 2004-012045, filed Jan. 20, 2004, the entire contents of which are incorporated herein by reference.

BACKGROUND OF THE INVENTION

1. Field of the Invention

The present invention relates to a decolorable image forming material that can be decolored by heating or contact with a decoloring solvent.

2. Description of the Related Art

Forest conservation is an essential requirement to maintain the terrestrial environment and suppress the greenhouse effect caused by $CO_2$. In order to promote wood resource saving and forest regeneration including tree planting, it is an important subject to efficiently use the paper resources that we presently possess. Currently, paper resources are "recycling" by recovering paper fibers from used paper through a deinking step of removing image forming materials printed on the used paper, remaking paper fibers to manufacture recycled paper with low paper quality, and using the recycled paper according to the purpose. Thus, problems of a high cost of the deinking step and possibility of new environmental pollution by waste fluid treatment are pointed out.

On the other hand, reuse of a hard copy has been put into practice through erasure of images, for example, by using an eraser for pencil images and a correcting fluid for ink images. Recently, rewritable paper as a type of special paper has been proposed in order to reuse hard copy paper sheets. Here, "reuse" in which a paper sheet is repeatedly used for the same purpose with preventing deterioration of paper quality as much as possible is different from "recycling" in which paper with deteriorated quality is used for other purposes. Now, the "reuse" can be said to be more important concept from a viewpoint of conservation of paper resources. If effective "reuse" at each "recycling" stage is performed, new waste of paper resources can be suppressed minimum.

The present inventors have paid their attention to a phenomenon caused by a system of a color former and a developer that a colored state is realized when interaction between the color former and the developer is increased and a decolored state is realized when the interaction is decreased. Thus, the inventors have proposed, as paper reuse techniques, image forming materials of a composition system comprising a color former, a developer and a decoloring agent having a property to capture the developer. The image forming materials can exhibit stably a colored state at temperatures around a room temperature and can retain a decolored state for a long term at practical temperatures by treatment with heat or a solvent. The inventors have also proposed image decoloring processes and image erasing apparatuses for the image forming materials. These image forming materials have advantages of high stability of colored and decolored states of the images, highly safety in view of materials, applicability to electrophotography toners, liquid inks, ink ribbons and writing instruments, and feasibility of large-scale decoloring treatment, which cannot be realized in any prior art.

The decolorable image forming materials, which we have proposed, have a great resource-saving effect, because they can promote reuse and recycling of paper and therefore can remarkably decrease waste paper. During further study of decolorable image forming materials, we have found that, if an image recording medium is made of a polar polymer such as paper and if a binder contained in the image forming material is made of a non-polar material having a property of easily capturing the color former by heating or contact with a solvent, even an image forming material without an decoloring agent having a property of capturing a developer can be decolored a few times by utilizing the ability of the image recording medium (paper) to capture the developer. Thus, we have also proposed an image forming material without the decoloring agent having the property of capturing the developer, and a method of decoloring the same (see, for example, Jpn. Pat. Appln. KOKAI Publication No. 2000-56477).

However, some problems have arisen during study of improving the composition system. The most difficult problem is limited contrast between the colored and decolored states in thermal decoloration. In the composition system, both the colored state and the decolored state are determined by equilibrium of interaction between the color former and the developer in the softened binder. For this reason, limitation of contrast is determined by temperature dependency of an equilibrium constant in the binder, and is determined by a manufacturing process temperature and a decoloring process temperature for the image forming material. That is, an optical density in a colored state (referred to as a colored optical density) is substantially determined dependent on the combination of selected materials. Therefore, there is a room for improving the colored optical density of the decolorable image forming material.

BRIEF SUMMARY OF THE INVENTION

A decolorable image forming material according to one aspect of the present invention comprises a color former and a developer that develop a colored state through interaction therebetween and can be decolored by heating or contact with a solvent, the developer comprising two or more compounds whose deference in molecular weight is 15 or more.

DETAILED DESCRIPTION OF THE INVENTION

Figure 1:
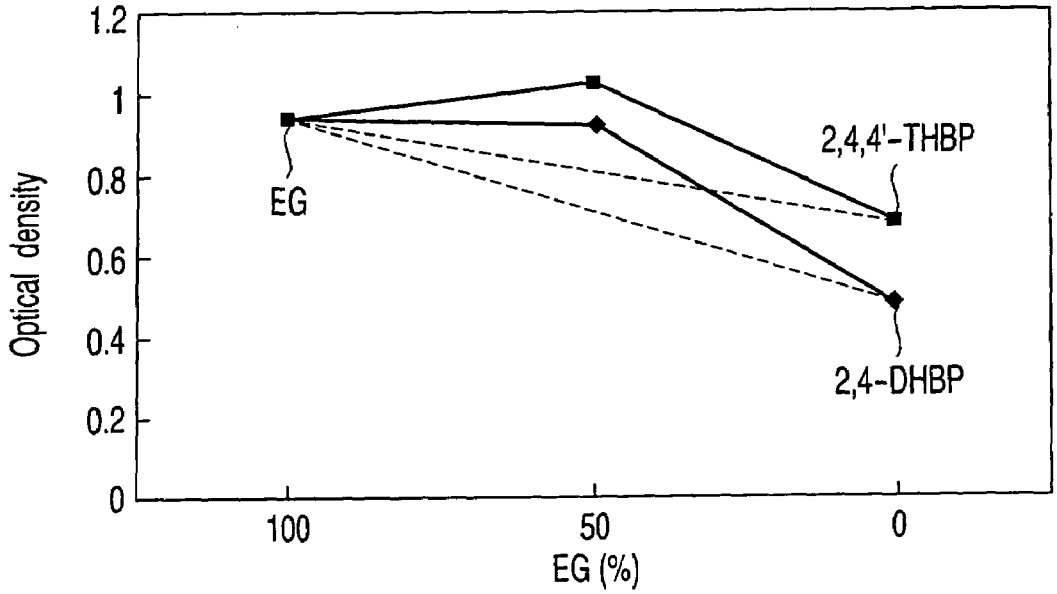
FIG. 1 is a graph showing relationship between the concentration of ethyl gallate in the developer and the colored optical density with respect to the image forming materials of Examples 1 and 2.

As a result of extensive study to improve a colored optical density of an image forming material comprising a color former and a developer, the present inventors found the following facts. That is, a colored optical density of an image forming material prepared by using two color formers (leuco dyes) and one developer is approximately equal to a sum of colored optical densities predicted from concentrations of individual color formers. However, it was found that an optical density of an image forming material prepared by using one color former (a leuco dye) and two developers could exceed a sum of colored optical densities predicted from concentrations of individual developers in some cases.

It is understood that such phenomena may be obtained depending on a combination of developers and conditions, but detailed mechanism thereof is unclear. Here, in an image forming material comprising one color former and one developer, it was has been found that a colored optical density is determined by an equilibrium constant of an equilibrium reaction between the color former and the developer in a resin binder. Even when an excessive amount of a developer is added for the purpose of advantageously developing a color in this equilibrium reaction, there is a tendency that the optical density is saturated. Therefore, in the image forming material comprising two or more developers, if a combination of developers is proper, it is understood that some synergistic effect is generated and the equilibrium shifts towards a direction to increase the colored optical density.

Components used in image forming materials according to the embodiments of the present invention will be described in detail below. Hereinafter, a color former, a developer, a binder resin, a charge control agent, and a wax will be described in this order.

Examples of the color former include electron-donating organic substances such as leucoauramines, diarylphthalides, polyarylcarbinols, acylauramines, arylauramines, rhodamine B lactams, indolines, spiropyrans, and fluorans. Specific examples of the color former are Crystal Violet Lactone (CVL), Malachite Green Lactone, 2-anilino-6-(N-cyclohexyl-N-methylamino)-3-methylfluoran, 2-anilino-3-methyl-6-(N-methyl-N-propylamino)fluoran, 3-[4-(4-pehnylaminophenyl)aminophenyl]amino-6-methyl-7-chlorofluoran, 2-anilino-6-(N-methyl-N-isobutylamino)-3-methylfluoran, 2-anilino-6-(dibutylamino)-3-methylfluoran, 3-chloro-6-(cyclohexylamino)fluoran, 2-chloro-6-(diethylamino)fluoran, 7-(N,N-dibenzylamino)-3-(N,N-diethylamino)fluoran, 3,6-bis(diethylamino)fluoran-γ-(4'-nitro) anilinolactom, 3-diethylaminobenzo[a]-fluoran, 3-diethylamino-6-methyl-7-aminofluoran, 3-diethylamino-7-xylidinofluoran, 3-(4-diethylamino-2-ethoxyphenyl)-3-(1-ethyl-3-yl)-4-azaphthalide, 3-(4-diethylaminophenyl)-3-(1-ethyl-2-methylindol-3-yl)phthalide, 3-diethylamino-7-chloroanilinofluoran, 3-diethylamino-7,8-benzofluoran, 3,3-bis(1-n-butyl-2-methylindol-3-yl)phthalide, 3-6-dimethylethoxyfluoran, 3-diethylamino-6-methoxy-7-aminofluoran, DEPM, ATP, ETAC, 2-(2-chloroanilino)-6-dibutylaminofluoran, Crystal Violet carbinol, Malachite Green carbinol, N-(2,3-dichlorophenyl)leucoauramine, N-benzylauramine, rhodamine B lactam, N-acetylauramine, N-phenylauramine, 2-(phenyliminoethanedilidene)-3,3-dimethylindoline, N-3,3-trimethylindolinobenzospiropyran, 8'-methoxy-N-3,3-trimethylindolinobenzospiropyran, 3-diethylamino-6-methyl-7-chlorofluoran, 3-diethylamino-7-methoxyfluoran, 3-diethylamino-6-benzyloxyfluoran, 1,2-dibenzo-6-diethylaminofluoran, 3,6-di-p-toluidino-4,5-dimethylfluora phenylhydrazide-γ-lactam, and 3-amino-5-methylfluoran. These color former compounds can be used singly or in the form of a mixture of two or more species. If color formers are selected properly, a variety of colored states can be obtained. Among them, triphenylmethane-based, fluoran-based, and phenylindole-phthalide-based color formers are particularly suitable.

Examples of the developer include phenols, metal phenolates, carboxylic acids, metal carboxylates, benzophenones, sulfonic acids, metal sulfonates, phosphoric acids, metal phosphates, acidic phosphoric esters, acidic phosphoric ester metal salts, phosphorous acids, and metal phosphites. Among them, examples of a particularly suitable material include gallic acid; gallate such as methyl gallate, ethyl gallate, n-propyl gallate, i-propyl gallate, and butyl gallate; dihydroxybenzoic acid and its ester such as 2,3-dihydroxybenzoic acid, and methyl 3,5-dihydroxybenzoate; hydroxyacetophenones such as 2,4-dihydroxyacetophenone, 2,5-dihydroxyacetophenone, 2,6-dihydroxyacetophenone, 3,5-dihydroxyacetophenone, and 2,3,4-trihydroxyacetophenone; hydroxybenzophenones such as 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, and 2,3,4,4'-tetrahydroxybenzophenone; biphenols such as 2,4'-biphenol, and 4,4'-biphenol; and polyhydric phenols such as 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol.

In the embodiments of the present invention, two or more compounds whose difference in molecular weight is 15 or more are used as developers. If the difference in molecular weight of two or more developers is less than 15, effect of improving the colored optical density cannot be obtained. In the embodiments of the present invention, it is preferable to select, as two or more developers, developers having dissimilar molecular structures each other, for example, a gallate-based developer and a benzophenone-based developer.

A suitable binder resin used in the embodiments of the present invention is a non-polar resin or a low-polarity resin. Specifically, a styrene-based resin may be suitably used. On the other hand, a resin containing many polar groups, such as an acrylic group, carbonyl group, ether group, ketone group, hydroxyl group and amido group, is not suitable for the binder resin. The reason is as follows: these resins have high compatibility with a developer having a phenolic hydroxyl group because the polar groups contribute to produce a hydrogen bond, shifts equilibrium between the color former and the developer towards separation thereof (decoloration) during a kneading step in a preparing process, and lowers the colored optical density of the image forming material. For example, when a decolorable toner is prepared using a fluoran dye, a gallate developer and a styrene-butyl acrylate binder resin, it is preferable that a butyl acrylate content of the binder resin is 10 wt % or less.

A charge control agent used for a decolorable toner is required to be colorless so that a color is not left upon decoloring. Among generally used charge control agents, as a negative charge control agent, compounds such as E-84 (zinc salicylate compound) manufactured by Orient Kagaku K.K., N-1, N-2 and N-3 (all are phenol-based compound) manufactured by NIPPON KAYAKU CO. LTD., FCA-1001N (styrene-sulfonic acid-based resin) of manufactured by FUJIKURA KASEI CO. LTD., and, as a positive charge control agent, compounds such as TP-302 (CAS #116810-46-9) and TP-415 (CAS #117342-25-2) manufactured by Hodogaya Chemical Co. Ltd., P-51 (quaternary amine compound) and AFP-B (polyamine oligomer) manufactured by Orient Kagaku K.K., and FCA-201PB (styrene-acrylic quaternary ammonium salt-based resin) manufactured by FUJIKURA KASEI CO. LTD are suitable materials. Acrylic fine particles can also be used as the charge control agent. Examples of negative charge control agent include acrylic fine particles MP-1451, MP-2200 and MP-1000 and styrene/acrylic copolymer fine particles MP-2701, which are manufactured by Soken Chemical & Engineering Co., Ltd., and examples of positive charge control agent include acrylic fine particles MP-2701 and styrene/acrylic copolymer fine particles MP-5500, which are manufactured by Soken Chemical & Engineering Co., Ltd.

In the decolorable toner according to the embodiments of the present invention, if necessary, a wax for controlling fixing property may be blended. It is preferable that the wax is formed of higher alcohol, higher ketone or higher aliphatic ester, and has an acid value of 10 or less. It is also preferable that the wax has a weight average molecular weight of $10^2$ to $10^4$. Low-molecular weight polypropylene, low-molecular weight polyethylene, low-molecular weight polybutylene, low-molecular weight polyalkane and the like can also be used if the weight average molecular weight is in the above range. It is preferable that the addition amount of wax is 0.5 to 10 parts by weight based on the total weight of the decolorable toner.

EXAMPLES

Examples of the present invention will be described below.

Example 1

Four Parts by weight of Blue 203 (manufactured by Yamada Kagaku Co., Ltd.) as a color former, 2 to 0 parts by weight of ethyl gallate (EG, molecular weight: 198) as a developer, 0 to 2 parts by weight of trihydroxybenzophenone (2,4,4'-THBP, molecular weight: 230), 3 parts by weight of polypropylene wax as a wax component, 1 part by weight of LR-147 (available from Japan Carlit Co., Ltd.) as a charge control agent, and 90 parts by weight of polystyrene (Mitsui Chemicals, Inc., XPA6638) as a binder resin were blended. As the developer, EG or 2,4,4'-THBP was used alone, or EG and 2,4,4'-THBP were used together in an equivalent molar mixture. In any case, the blending weight of the developer was set to 2 parts by weight (for mixture, the total blending weight was set to 2 parts by weight). These components were sufficiently kneaded and dispersed using a closed-type kneader and then ground and classified into fine powder having an average particle size of about 9.5 μm. Thereafter, hydrophobic silica was externally added at 1 wt % based on the total weight to prepare a decolorable blue toner for electrophotography. The colored optical density of the resultant toner powder was measured by using a colorimeter (CR300) manufactured by Minolta.

Example 2

A decolorable blue toner for electrophotography was prepared in the same manner as in Example 1 except that dihydroxybenzophenone (2,4-DHBP, molecular weight: 214) was used in place of trihydroxybenzophenone, and an optical density of the toner powder was measured.

FIG. 1 is a graph showing relationship between the concentration of ethyl gallate in the developer and the colored optical density with respect to the image forming materials of Examples 1 and 2. This figure shows a colored optical density predicted from additive property of concentrations of individual developers in each case by a broken line. As seen from FIG. 1, when two developers such as EG and 2,4,4'-THBP or EG and 2,4-DHBP are used, color developing effect remarkably exceeding the optical density predicted from additive property of concentrations of individual developers was obtained.

Comparative Example

Four Parts by weight of Blue 203 (manufactured by Yamada Kagaku Co., Ltd.) as a color former, 2 to 0 parts by weight of ethyl gallate (EG, molecular weight: 198) as a developer, 0 to 2 parts by weight of n-propyl gallate (PG, molecular weight: 212), 3 parts by weight of polypropylene wax as a wax component, 1 part by weight of LR-147 (available from Japan Carlit Co., Ltd.) as a charge control agent, and 90 parts by weight of polystyrene (Mitsui Chemicals, Inc., XPA6638) as a binder resin were blended. As the developer, EG or PG was used alone, or EG and PG were used together in an equivalent molar mixture. In any case, the blending weight of the developer was set to 2 parts by weight (for mixture, the total blending weight was set to 2 parts by weight). These components were sufficiently kneaded and dispersed using a closed-type kneader and then ground and classified into fine powder having an average particle size of about 9.5 μm. Thereafter, hydrophobic silica was externally added at 1 wt % based on the total weight to prepare a decolorable blue toner for electrophotography. The colored optical density of the resultant toner powder was measured by using a calorimeter (CR300) manufactured by Minolta.

Figure 2:
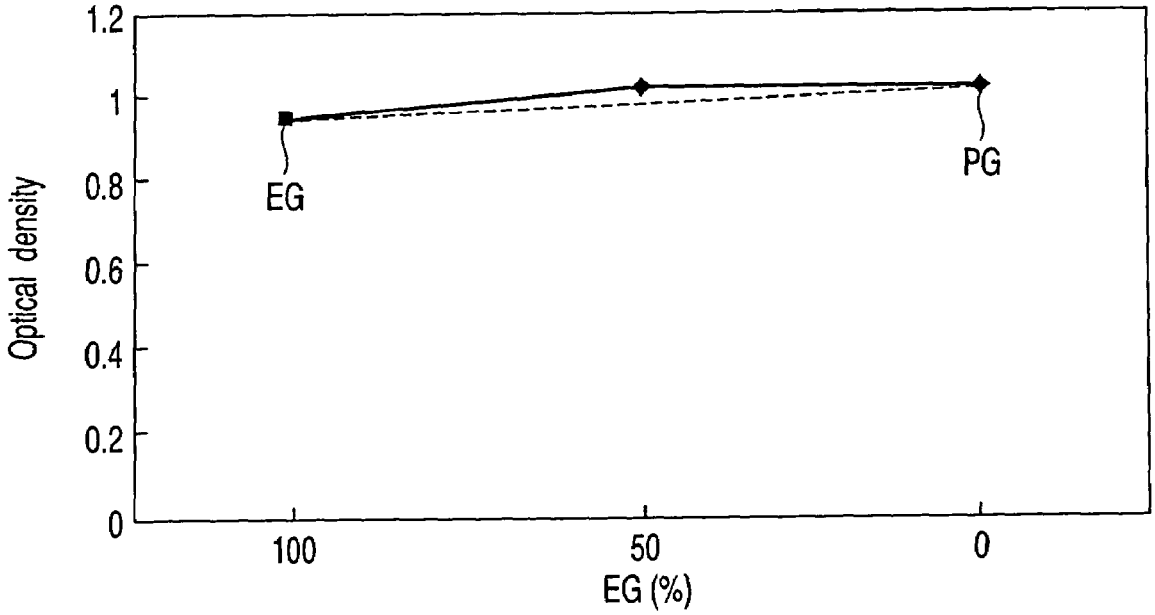
FIG. 2 is a graph showing relationship between the concentration of ethyl gallate in the developer and the colored optical density with respect to the image forming material of Comparative Example.

FIG. 2 is a graph showing relationship between the concentration of ethyl gallate in the developer and the colored optical density with respect to the image forming material of Comparative Example. As seen from FIG. 2, even if two developers are used, a combination of EG and TG gives little effect of improving the optical density.

By comparison of FIGS. 1 and 2, it is predicted that use of two developers having different molecular structures is effective to improve the colored optical density.

Figure 3:
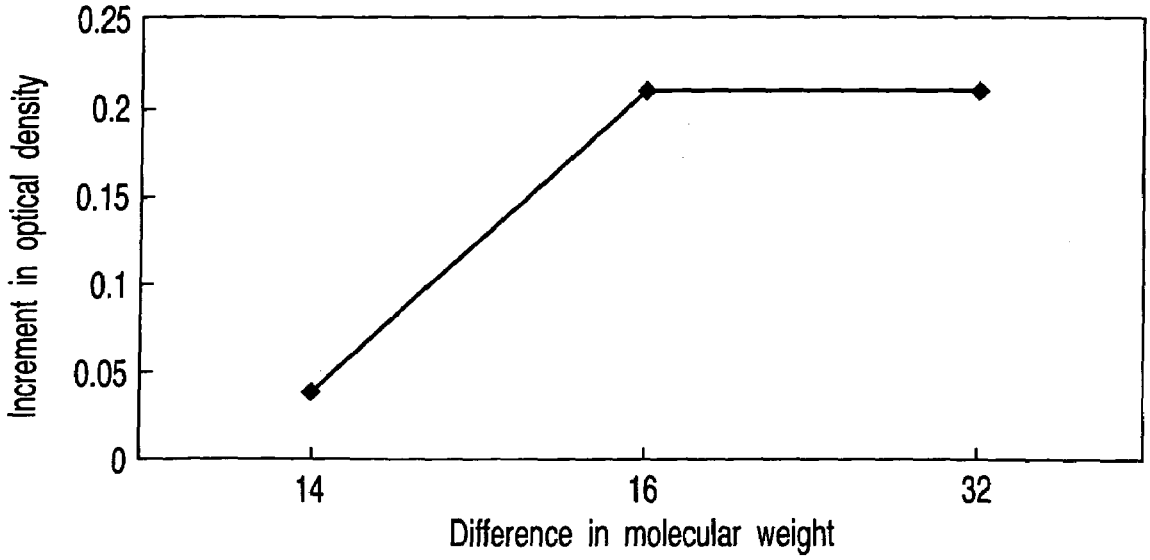
FIG. 3 is a graph showing relationship between the difference in molecular weight of the two developers and the increment in the colored optical density.

Further, FIG. 3 shows the relationship between the difference in molecular weight of the two developers and the increment in colored optical density (the difference between the actually measured value and the predicted value) with respect to the toner powder of Examples 1 and 2 and Comparative Example. It is seen from FIG. 3 that the difference in molecular weight of two developers should preferably be set to 15 or more.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A decolorable image forming material comprising a color former and a developer that develop a colored state through interaction therebetween and can be decolored by heating or contact with a solvent, the developer comprising two or more compounds whose deference in molecular weight is 15 or more, wherein the two or more compounds are selected from a gallate-based developer and a benzophenone-based developer, and wherein the gallate-based developer is ethyl gallate, and the benzophenone-based developer is 2,4-dihydroxybenzophenone.

2. The decolorable image forming material according to claim 1, further comprising a binder resin.

3. The decolorable image forming material according to claim 2, wherein the binder resin is a polystyrene-based resin.

4. The decolorable image forming material according to claim 1, further comprising a charge control agent.

5. The decolorable image forming material according to claim 1, further comprising a wax component.

6. The decolorable image forming material according to claim 1, wherein the image forming material is printed on a paper medium in a form of a toner.

7. The decolorable image forming material according to claim 1, further comprising a binder resin, a charge control agent, and a wax component.

8. A decolorable image forming material comprising a color former and a developer that develop a colored state through interaction therebetween and can be decolored by heating or contact with a solvent, the developer comprising two or more compounds whose deference in molecular weight is 15 or more, wherein the two or more compounds are selected from a gallate-based developer and a benzophenone-based developer, and wherein the gallate-based developer is ethyl gallate, and the benzophenone-based developer is 2,4,4'-trihydroxybenzophenone.

9. The decolorable image forming material according to claim 8, further comprising a binder resin.

10. The decolorable image forming material according to claim 9, wherein the binder resin is a polystyrene-based resin.

11. The decolorable image forming material according to claim 8, further comprising a charge control agent.

12. The decolorable image forming material according to claim 8, further comprising a wax component.

13. The decolorable image forming material according to claim 8, wherein the image forming material is printed on a paper medium in a form of a toner.

14. The decolorable image forming material according to claim 8, further comprising a binder resin, a charge control agent, and a wax component.

* * * * *